US005953889A

United States Patent [19]

Jones

[11] Patent Number: 5,953,889

[45] Date of Patent: Sep. 21, 1999

[54] SADDLE TREE FOR A VERTICAL BALANCE SADDLE

[76] Inventor: David E. Jones, 3600 Kiphen Rd., Round Rock, Tex. 78664

[21] Appl. No.: 08/888,068

[22] Filed: Jul. 3, 1997

[51] Int. Cl.[6] ..... B68C 1/02

[52] U.S. Cl. ..... 54/44.1

[58] Field of Search ..... 54/44.1, 44.7

[56] References Cited

U.S. PATENT DOCUMENTS

| | | | |
|---|---|---|---|
| 213,418 | 3/1879 | Herring | 54/44.1 |
| 474,226 | 5/1892 | Dennis et al. | 54/44.1 |
| 3,153,887 | 10/1964 | Bohlin | 54/44.7 X |
| 3,780,494 | 12/1973 | Nankivell, Jr. | 54/44.7 |

*Primary Examiner*—Robert P. Swiatek

*Attorney, Agent, or Firm*—Russell D. Culbertson; Shaffer & Culbertson, LLP

[57] ABSTRACT

A saddle tree (10) for use in building a western equestrian saddle includes two laterally spaced, elongated bars (12) adapted to extend along either side of the horse's spine when the saddle tree (10) is in a riding position on the horse. A swell (14) is connected between the laterally spaced bars (12) at a forward end of the bars (12). A stirrup slot (20) is positioned in a center portion (18) of each bar for accepting the stirrup leathers for the saddle. Each stirrup slot (20) has a front edge (40) positioned at least two and one-eighth inches behind the back surface (28) of the swell (14). A center seat section or ground seat (18) positioned between the laterally spaced bars (12) includes a lowest point along its centerline positioned at least four inches behind the back surface (28) of the swell (14) and no more than eight inches behind the back surface (28) of the swell (14).

7 Claims, 3 Drawing Sheets

SADDLE TREE FOR A VERTICAL BALANCE SADDLE

BACKGROUND OF THE INVENTION

This invention relates to equestrian or western horseback riding saddles and, more particularly, to a saddle tree used in building or constructing such a saddle.

Saddles for western horseback riding are generally built around a form referred to as a "saddle tree". The saddle tree determines the configuration and size of the saddle and provides structural support for the leather and other materials which form the outer portions of the saddle.

A saddle tree generally includes two longitudinal members referred to as bars which are laterally spaced apart and extend generally parallel to each other. When the saddle tree and saddle are positioned on the horse in a riding position, the bars extend along either side of the horse's spine and provide a structure for transferring weight to the horse. To better distribute the weight of the saddle and rider, the bars include a wide front section and a wide rear section.

A cross-member referred to as a swell connects the bars at their forward end. Another cross-member referred to as the cantle connects the bars at the rear. The cantle forms the back surface which supports the rider and generally prevents the rider from moving further rearwardly in the saddle.

A center seat section extends between the bars in the area between the swell and cantle. This center seat section may form part of the saddle tree referred to as the ground seat, or may simply comprise leather or other material placed over the bars and technically, not part of the saddle tree.

Saddle trees generally include an arrangement for supporting the stirrups for the saddle. The arrangement may include a stirrup slot or indentation routed or otherwise formed on each bar. The stirrup slot defines an area which accepts the stirrup leathers. The slot also generally includes an opening along a top edge from which the stirrup leathers may be hung.

In prior saddle trees which include stirrup slots, the slots are positioned well forward on the tree, generally immediately behind the swell. However, the low part or ground seat of the center seat section, which defines where the rider sits in the saddle, is positioned well behind the position of the stirrup slots. Thus, as a rider sits in the saddle, with their feet in the stirrups, the rider's legs extend well forward of the rider's center of gravity. In order for the rider to stand up in these prior saddles, for example when the horse is trotting or galloping, the rider must lean forward and try to pull their legs and stirrups back while pulling their body forward. Thus, standing up in the saddle is difficult and requires much practice and riding skill.

Another problem with prior saddles is that the saddle trees are not constructed to distribute the weight sufficiently on the horse. Many saddle trees produce saddles which concentrate weight in sensitive areas on the horse, such as along the horse's spine and withers.

SUMMARY OF THE INVENTION

It is an object of the invention to provide a saddle tree which overcomes the above-described problems and other problems associated with saddle trees and saddles. More particularly, it is an object of the invention to provide a saddle tree from which a saddle may be constructed to provide improved balance for the rider and reduced fatigue and injury for the horse.

To accomplish these objects, a saddle tree according to the invention, includes a unique stirrup slot position with respect to the swell and center seat section. The preferred stirrup slot is positioned in a substantially narrowed center portion of each bar. The slot includes an indentation for accepting the stirrup leathers and has a front edge, rear edge, and preferably a top edge and a top opening from which the stirrup leathers may be hung. The preferred slot includes an indentation on both sides of the bar, both on the outer surface and on the inner surface nearest the horse's back. The front edge of the stirrup slot is at least two and one-eighth inches behind the back surface of the swell. Also, the front edge of each stirrup slot extends substantially vertically when the saddle tree is in the riding position. This placement of the stirrup slot places the vertically hanging stirrups generally in line with the center of gravity of the rider's upper body when the rider is sitting in the saddle produced from the saddle tree.

In the preferred form of the invention, the center seat section of the saddle tree has a lowest point along its centerline which is at least four inches and no more than eight inches behind the back surface of the swell. Since the lowest point of this center seat section defines where the rider sits along the saddle tree, this center seat section arrangement according to the invention places the rider's center of gravity generally over the stirrups.

The saddle tree according to the invention also includes features to decrease the fatigue on the horse. The saddle tree preferably includes long bars with bar pads extending well forward of the swell and rearwardly from the cantle. Also, a bottom surface of the center seat section is positioned well above the bars. This center seat section feature produces a raised area between the bars which eliminates or at least reduces the pressure of the saddle and rider on the spine of the horse.

These and other objects, advantages, and features of the invention will be apparent from the following description of the preferred embodiments, considered along with the accompanying drawings.

DESCRIPTION OF THE PREFERRED EMBODIMENTS

Figure 1:
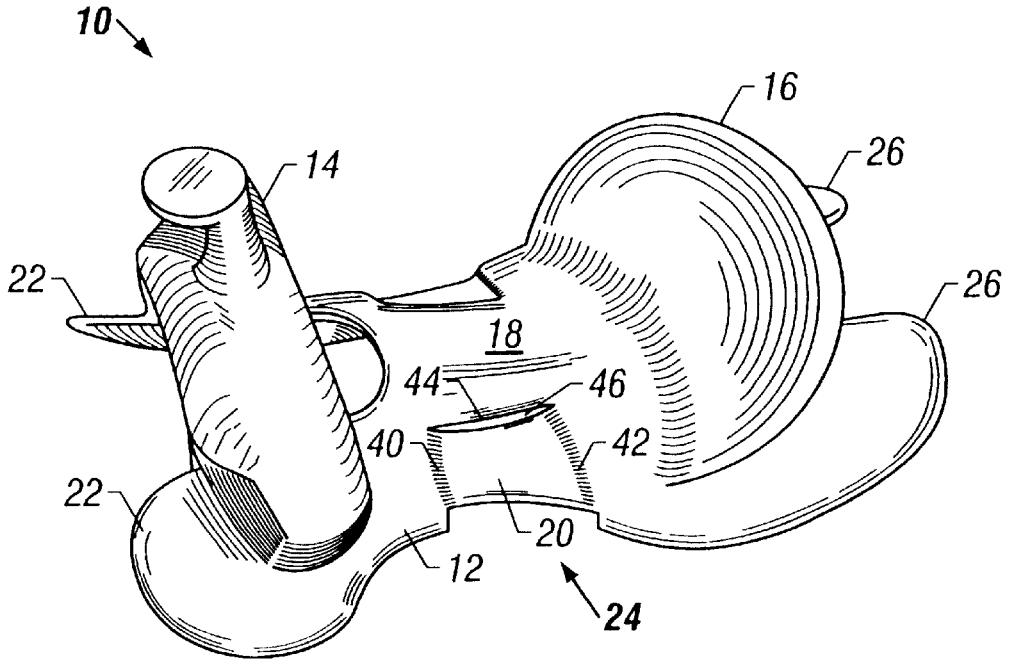
FIG. 1 is a view in perspective of a saddle tree embodying the principles of the invention.
Figure 2:
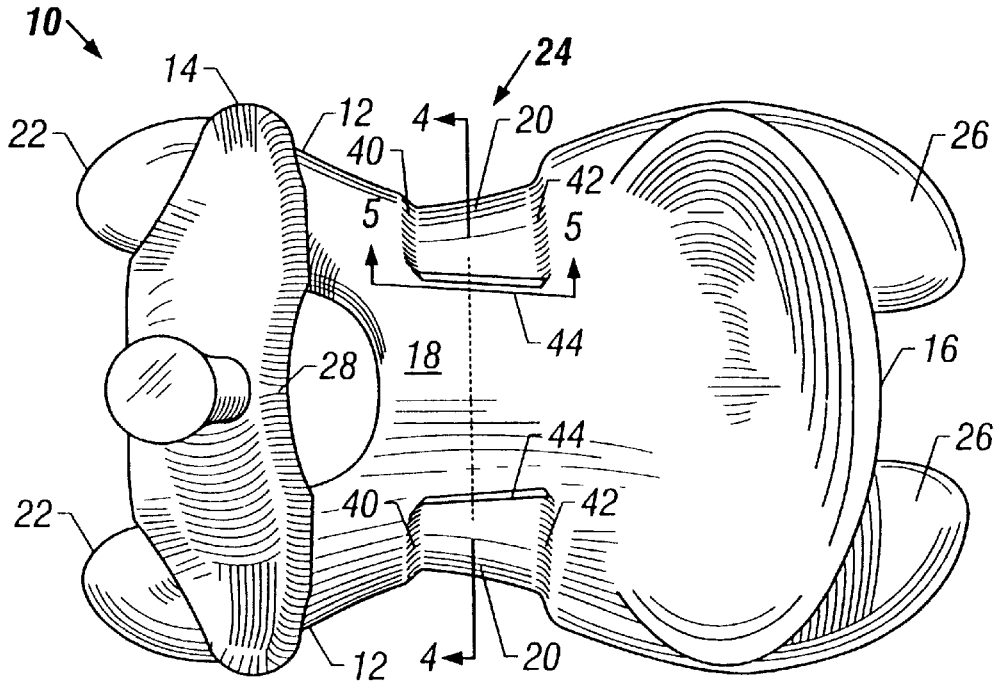
FIG. 2 is a top view of the saddle tree shown in FIG. 1.
Figure 3:
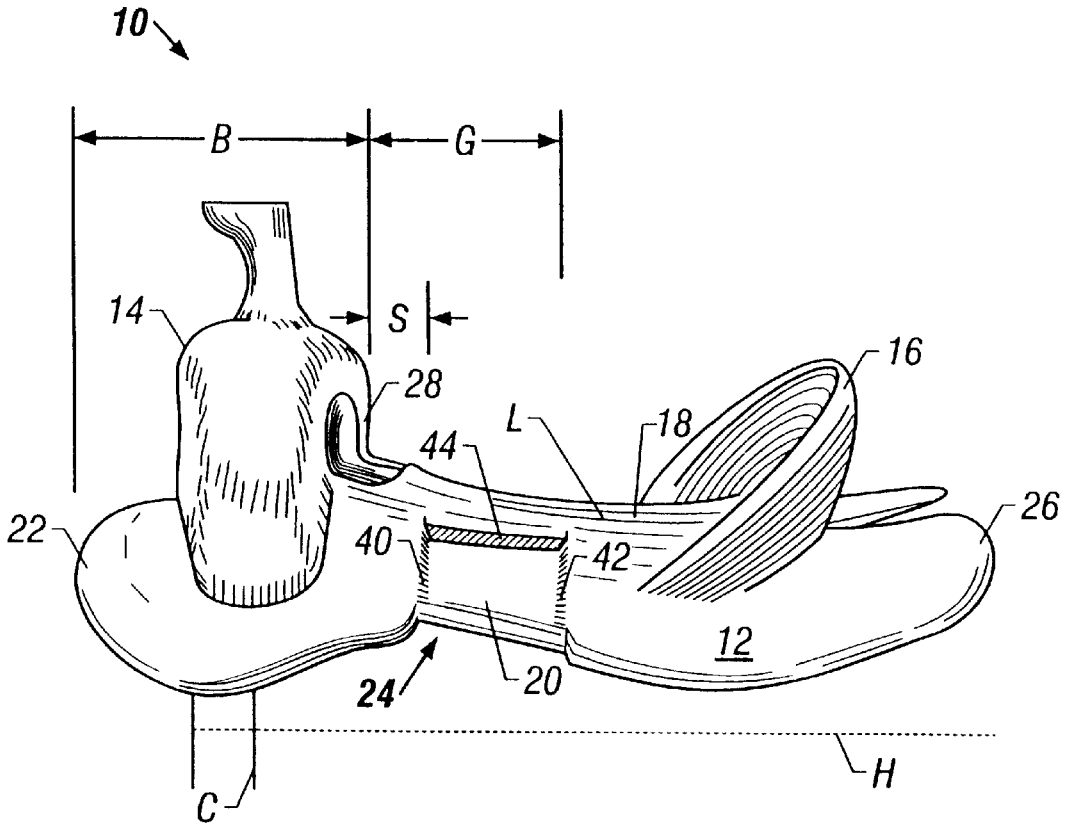
FIG. 3 is a side elevation of the saddle tree shown in FIG. 1.

FIGS. 1 through 5 illustrate a saddle tree 10 embodying the principles of the invention. Referring particularly to FIGS. 1 through 4, the saddle tree 10 includes two elongated bars 12. A swell 14 connects the two bars 12 near the front of the bars and a cantle 16 connects the bars toward the rear. A center seat section 18 or ground seat also connects the bars 12 in the area between the swell 14 and the cantle 16. The saddle tree 10 also includes two stirrup slots 20, one associated with each bar 12. The bars 12, cantle 16 and swell 14, are preferably made from wood and then covered with a composite material, preferably fiberglass, to enhance strength and to produce the ground seat 18. However, those skilled in the art will readily appreciate that any suitable materials may be used to produce a saddle tree 10 embodying the principles of the invention. FIG. 3 shows the relation of the saddle tree 10 to a horizontal line H when the saddle tree is in the riding position.

Figure 4:
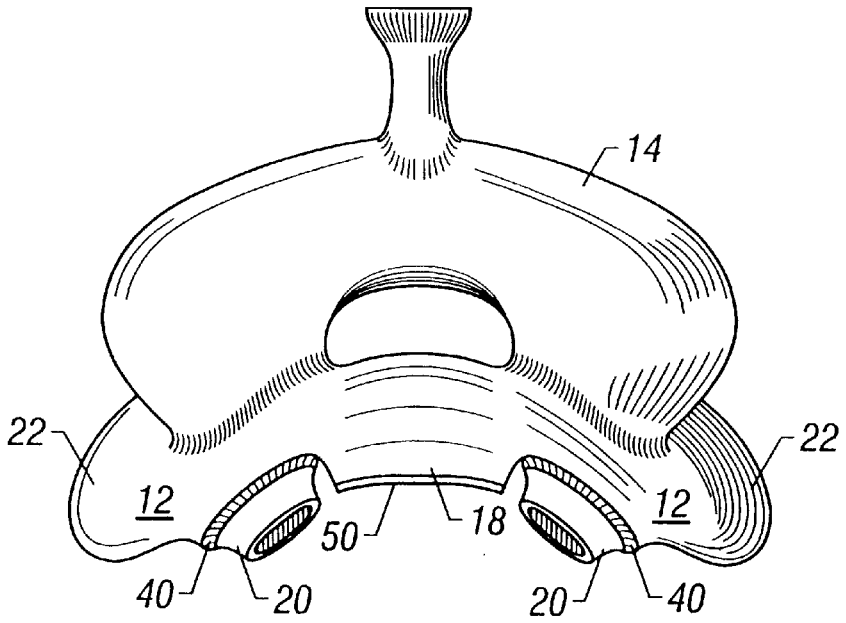
FIG. 4 is a view in transverse section taken along Line 4—4 in FIG. 2.
Figure 5:
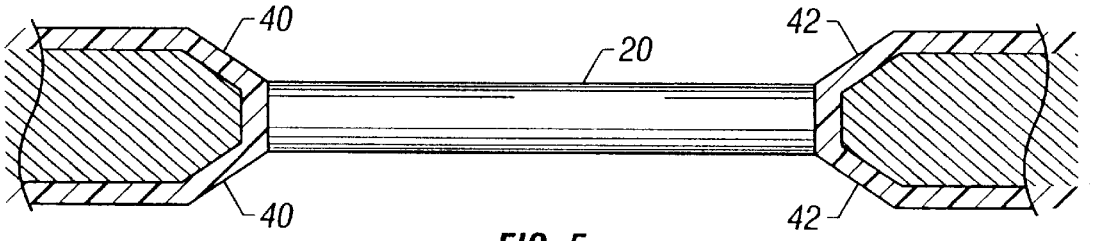
FIG. 5 is a partial section view taken along Line 5—5 in FIG. 2.

The bars 12 extend generally parallel to each other. When the saddle tree 10 is incorporated into a saddle and the saddle is placed in a proper riding position on the horse, the bars extend along either side of the spine of the horse. As best shown in FIG. 4, the bars slope downwardly in the lateral direction to conform generally to the curvature of the back of the horse along the base of the rib cage and withers area.

Each bar 12 includes a front bar portion 22, a narrow center portion 24, and a rear bar portion 26. The front and rear bar portions 22 and 26 are widened with respect to the center portion 24 and function to distribute the weight of the saddle and rider over a large area on the horse. The area under the front bar portion 22 residing nearest the horse is referred to as the front bar pad. As will be discussed below, the front bar portion and front bar pads according to the invention are extended forward to better distribute the weight on the horse.

The swell 14 is connected over the front bar portions 22 of the bars 12 and includes a back surface 28 which faces the rider in the saddle. The cantle 16 is connected to the bars 12 near or over the rear bar portions 26. In the illustrated form of the invention, the center seat section 18 comprises a ground seat which actually forms part of the saddle tree 10 and extends forward on the saddle from the base of the cantle 16. In other forms of the invention, the center seat section 18 may not form part of the saddle tree 10 and may simply comprise leather or other material positioned over the bars 12 in the area between the cantle 16 and swell 14. Either arrangement is to be considered a center seat section within the scope of this disclosure and the following claims.

The stirrup slots 20 according to the invention are formed in the center portion 24 of the bars 12. Referring to all of the figures, but particularly FIG. 5, each slot 20 comprises a narrowed or routed area on both sides of the bar 12 and includes a front edge 40 and a rear edge 42. The front edge 40 and rear edge 42 extend vertically when the saddle tree 10 is in the riding position. In the preferred form of the invention, each slot 20 also includes a top edge 44 and a stirrup opening 46. The top edge 44 extends generally horizontally when the saddle tree 10 is in the riding position. The function of each slot 20 is to accommodate the stirrup leathers which attach the stirrups to the saddle. In the illustrated form of the invention with the top edge 44 and top opening 46, the stirrup leathers (not shown) loop through the opening 46 and hang from the top edge 44, passing through the recessed area of the slots 20. The slots 20 are located according to the invention in a unique position with respect to the swell 14 and the center seat section 18 of the saddle tree 10.

According to the invention, the stirrup slots 20 are positioned well behind the swell 14. Regardless of the size of the saddle, the front edge 40 of the slot 20 is at least two and one-eighth inches behind the back surface 28 of the swell 14 (illustrated as dimension S). This stirrup position, particularly combined with the center seat section arrangement discussed below, places the vertically hanging stirrups (not shown) generally under the rider's center of gravity as they sit in a saddle produced around the saddle tree 10.

As shown best in FIG. 3, the center seat section 18 curves or slopes downwardly from the front and curves up in the rear to meet the cantle 16. A lowest point or area L along the centerline of the center seat section 18 defmes where the rider rests when they are sitting in a saddle built around the saddle tree. According to the invention, the lowest point L along the centerline of the center seat section 18 is positioned at least four inches behind the back surface 28 of the swell 14, but no more than eight inches from the back surface of the swell (illustrated as dimension G). In this range, and with the stirrup slots 20, at least two and one-eighth inches behind the back surface 28 of the swell 14, the point or area L overlaps or is immediately behind the longitudinal position of the stirrup slots 20. In this position, the rider has much better vertical balance and their center of gravity is substantially over or nearly over their feet resting in the stirrups.

The position of the stirrup slots 20 may also be described relative to the dimension G in FIG. 3. With the front edge 40 of each stirrup slot 20 at least two and one-eighth inch behind the back surface 28 of the swell 14, the dimension S is at least 27% of the dimension G.

In another aspect of the invention, the saddle tree 10 employs an improved center seat section 18 placement and front bar pad arrangement to reduce the fatigue and injury to the horse. As best shown in FIG. 4, the bottom surface 50 of the center seat section 18 is positioned well above the bars 12. In the preferred form of the invention the bottom surface 50 at a point one inch behind the most forward point where the cantle 16 is attached to the bars 12, is raised at least one inch above a horizontal line across the bars 12 at the highest point of the bottom of the rear bar portions. This location for the bottom surface 50 produces a raised area extending along the center of the saddle tree 10 between the bars 12. This raised area prevents substantially any weight from being applied from the saddle to the spine of the horse.

Also, the bars 12 extend well forward of the swell 14 and well back of the swell 14 to better distribute weight. In a preferred form of the invention, each front bar 22 extends at least five and one-half inches forward of the back surface 28 of the swell 14 (dimension B). Also, the vertical centerline C of the swell 14 is positioned behind the lowest part of the front bar portions 22 as the saddle tree is oriented in the riding position. The overall length of each bar 12 is preferably at least twenty-two and one-half inches regardless of the size of the saddle.

Dimension G may be expressed in terms relative to the position of the swell 14 on the bars 12. Expressed in this way, dimension G is no greater than 59% of the total distance B plus G illustrated in FIG. 3.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A saddle tree for use in building a western equestrian saddle and adapted to reside in a riding position on a horse, the saddle tree comprising:

(a) two laterally spaced, elongated bars adapted to extend along either side of the spine of the horse when the saddle tree is in the riding position;

(b) a swell connected between the laterally spaced bars at a forward end of the bars, the swell having a back surface;

(c) a center seat section positioned between the laterally spaced bars, the distance between the back surface of the swell to a lowest point along a centerline of the center seat section being no greater than 59% of the distance between the lowest point of the center seat section and the front of the bars; and (d) a stirrup slot in a center portion of each bar, each stirrup slot for accepting stirrup leathers for the saddle, the distance between a front edge of the stirrup slot for each bar and the back surface of the swell being at least 27% of the distance between the back surface of the swell and the lowest point of the center seat section.

2. The saddle tree of claim 1 further comprising:

(a) a bottom surface of the center seat section being positioned above the bars to form a raised area between the bars for reducing pressure along the spine of the horse.

3. The saddle tree of claim 1 wherein:

(a) the bars extend forward at least five and one-half inches from the back surface of the swell.

4. The saddle tree of claim 1 wherein:

(a) the bars each include a front bar portion; and (b) a vertical centerline of the swell is positioned behind the lowest point of each front bar portion when the saddle tree is in the riding position.

5. The saddle tree of claim 1 wherein the overall length of each bar is at least twenty-two and one-half inches.

6. The saddle tree of claim 1 wherein the front edge of each stirrup slot extends substantially vertically when the saddle tree is in the riding position.

7. The saddle tree of claim 1 wherein each stirrup slot is recessed from adjacent areas of the saddle tree on both a top surface of the saddle tree and a bottom surface of the saddle tree.

* * * * *